United States Patent [19]

Schiron et al.

[11] 4,106,134

[45] Aug. 15, 1978

[54] LIFTING FLOORS FOR SWIMMING POOLS

[76] Inventors: Klaus Schiron, Nelkenstrasse 2, 3100 Celle; Hans Friedrich Rupprath, Am goldenen Acker 35, 3001 Bennigsen, both of Fed. Rep. of Germany

[21] Appl. No.: 753,208

[22] Filed: Dec. 22, 1976

[30] Foreign Application Priority Data

Dec. 22, 1975 [DE] Fed. Rep. of Germany ..... 2557881

[51] Int. Cl.[2] ..... E04H 3/19

[52] U.S. Cl. ..... 4/172.13; 52/29

[58] Field of Search ..... 4/172.13; 52/29

[56] References Cited

U.S. PATENT DOCUMENTS

| | | | |
|---|---|---|---|
| 3,052,893 | 9/1962 | McClure | 4/172.13 |

FOREIGN PATENT DOCUMENTS

| | | | |
|---|---|---|---|
| 1,914,286 | 10/1970 | Fed. Rep. of Germany | 4/172.13 |
| 493,720 | 8/1970 | Switzerland | 4/172.13 |
| 1,194,924 | 6/1970 | United Kingdom | 4/172.13 |
| 1,190,895 | 5/1970 | United Kingdom | 4/172.13 |

*Primary Examiner*—Alfred C. Perham
*Attorney, Agent, or Firm*—Beall & Jeffery

[57] ABSTRACT

Lifting floor for swimming pool comprising a height adjustable selfsupporting plate which is carried by lifting columns extending substantially the whole height of the swimming pool, the lifting columns being formed as supporting columns of corrosion resistant material resting on the pool bottom, braced against tipping inwardly by the lifting floor and against tipping outwardly by directly supporting against the pool walls, and passing through holes in the lifting floor.

11 Claims, 3 Drawing Figures

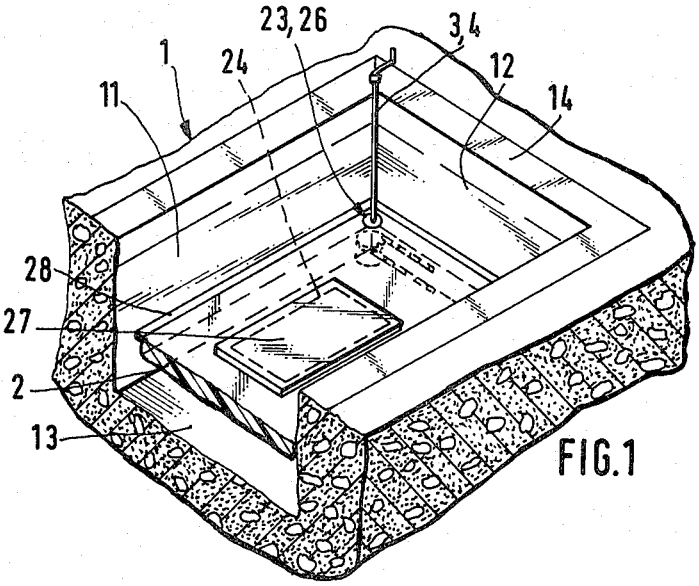
FIG.1
FIG.2
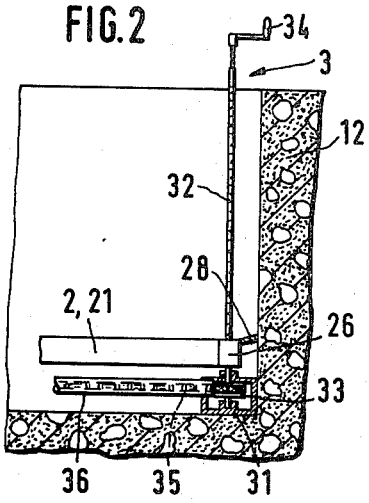
FIG.3
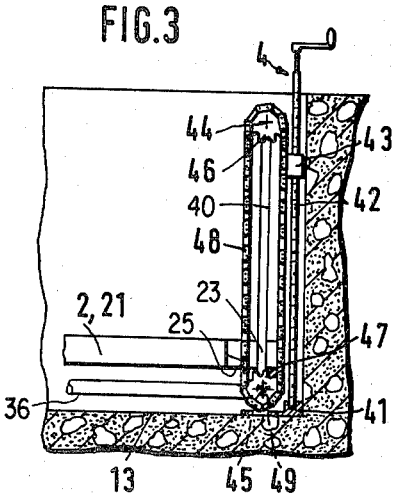

LIFTING FLOORS FOR SWIMMING POOLS

BACKGROUND OF THE INVENTION

1. Field of Invention

The invention relates to a lifting floor for swimming pools including means for elevation movement in which the lifting floor comprises a selfsupporting plate which is carried by lifting or raising elements in the form of lifting columns situated immediately adjacent the edge of the pool, particularly in the corners, which columns carry the driving means for the elevation movement and extend substantially the whole height of the swimming pool.

2. Description of Prior Art

A known device of this type (see Swiss Pat. No. 493,720) serves primarily to cover the swimming pool and thus is additionally supposed to reliably ensure that neither people nor objects fall in and is supposed further to enable the depth of the swimming pool to be adjusted in accordance with the requirements. For this purpose a single or multipart coverplate is arranged so as to be raised or lowered by means of lifting ropes which are powered by a winch device having a crank handle mounted on the pool periphery, or by means of threaded spindles and guide rods which are secured to or within the edge of the pool. In these known arrangements either the pool peripheral area is obstructed by the mechanical lifting devices or mountings for the guide rods or threaded spindles must be provided on resp. in the pool periphery thus incurring additional expense in construction. Particularly in the case of a subsequent conversion of an existing swimming pool, preferably a smaller private swimming pool, not only is relatively high expense necessary as a result of the required work on the walls, mountings etc. but also the volume of the pool which is available for use is restricted because either mechanical devices must be installed on the pool periphery or the spindles require a broader gap between the cover plate and the pool edge because they guide the plate by means of guide elements secured to its edge. Elastic strips are provided to cover this gap. However, these can only partially reduce the danger of an accident at the edge of the pool.

OBJECT OF INVENTION

The main objects of the present invention are to provide for a lifting floor which can be subsequently installed without structural alteration in existing swimming pools, particularly rectangular swimming pools and which in its lowered position does not reduce the depth of the swimming pool, and in every position does not reduce either the breadth or the length of the swimming pool and which may be easily moved between the different positions and in the raised position serves as a cover substantially reducing water evaporation.

SUMMARY OF THE INVENTION

In accordance with the present invention these objects are achieved by a lifting floor of the described type in which the lifting columns are formed as supporting columns of corrosion resistant material resting on the pool bottom, braced against tipping inwardly by the lifting floor and against tipping outwardly by directly supporting against the pool walls, and passing through holes in the lifting floor.

Thus the invention contemplates an installation which can be placed in a swimming pool practically in one piece, that is to say in particular in an existing swimming pool, without any structural alterations or additional expenditure on the pool being necessary. The raising columns of the lifting floor constructed in accordance with the invention are merely placed in the corners of the swimming pool on the bottom and are braced or supported against tipping outwardly by the pool edge and against tipping inwardly by the framework which forms the outer boundary of the floor. The lifting floor therefore represents a closed supporting surface and not as in the case of the known devices a grid so that it is possible due to the fact that the lifting elements pass through holes in the floor, to continue resp. extend the floor plate practically right up to the pool wall only leaving a very small gap. Seen as a whole particularly private swimming pools find a more general application by the use of such lifting floors which may be later installed and which do not significantly reduce the useful volume of the pools.

So as to make allowances for the requirements of hygiene and so as to be able to clean the pool simply and rapidly the lifting floor is preferably provided with coverable apertures which form an opening through which one may climb and through which there is access to the pool bottom, that is to say the space below the lifting floor plate.

Although the special construction of the lifting floor with the holes through which the lifting columns pass enables a practically sealing fit with the pool walls it is possible that the lifting floor can additionally be provided around its edge with a flexible seal which, however, in contrast to the wide covers used in the known arrangement is only a very narrow lip.

According to a preferred embodiment of the invention the lifting floor may include supporting beams which are provided at their ends with spindle nuts serving as connectors and the raising supports may include spindles which are supported in spindle bearings resting on the bottom of the pool, and which are connected together by means of endless chains guided by tubes of plastics material, and each of which carries one of the spindle nuts. Such a construction enables the height of the floor to be simply adjusted within the scope of given possibilities in particular when using a low powered drive of either manual or motorised type for the spindles.

In another preferred embodiment of the invention the lifting floor is connected at each of its corners to the lifting elements in the form of an endless chain by means of the respective connection, the chain passing around a guide wheel pivoted about an axis mounted perpendicular to a longitudinal wall in the region of the upper edge of the swimming pool, and lower down around a drive wheel secured to a shaft which extends between the two longitudinal walls above the bottom of the swimming pool. With this embodiment, in which a Gull's chain (plate link chain) may preferably be used, not only does the simple infinitely adjustable movability permit any desired depth of water to be achieved but also the lifting floor may be inclined at an angle. To achieve a simple and, specially for this purpose, economic drive system a chain at each transverse wall of the swimming pool may be connected by means of a spindle slide to a spindle which is supported on the bottom of the swimming pool by means of a spindle bearing.

BRIEF DESCRIPTION OF THE DRAWINGS

Other and further objects of the present invention will be apparent. from the following description and claims and are illustrated in the accompanying drawings which by way of illustration show preferred embodiments of the present invention and the principles thereof and what now are considered to be the best modes contemplated for applying these principles. Other embodiments of the invention embodying the same or equivalent principles may be used and structural changes may be made as desired by those skilled in the art without departing from the present invention and the scope of the appended claims.

In the schematic drawings:

FIG. 1 is an axonometric view of the right hand section of a swimming pool constructed in accordance with the invention;

FIG. 2 is a partial section through a modified construction of a swimming pool; and FIG. 3 is a partial section corresponding to FIG. 2 through yet another modification.

DESCRIPTION OF THE PREFERRED EMBODIMENT

A swimming pool 1 of a rectangular plan is defined by two longitudinal walls 11 the ends of which are connected by two transverse walls 12 and a bottom 13 and is provided on its upper edges with a surrounding rim 14. In this is situated a lifting floor 2 which comprises a framework which is not further described and the length and breadth of which are such that it fits snugly with a very small space between it and the longitudinal and transverse walls, and a continuous lining or cover so that the lifting floor forms a closed, supporting surface. Along its edges the lifting floor 2 is provided with a narrow flexible sealing strip 28 which both bridges and at the same time seals a small gap which of necessity remains along the walls 11 and 12 of the swimming pool 1. In the left rear corner of the swimming pool one can see a lifting column 3, 4 which is provided with a crank handle and which passes through a hole 23 in the lifting floor 2 and a chain drive connected to the lower end of the lifting column. The lifting column 3, 4 is formed as a supporting column which rests firmly on a suitable formed base on the pool bottom 13. The base is not shown or described in detail because its construction as such may vary. The supporting or lifting column is braced laterally by the pool walls since it is arranged right in the corner of the swimming pool and is secured against tipping inwardly by the framework of the lifting floor 2 and is braced via the latter by the raising supports 3, 4 in the other corners of the swimming pool.

The supporting columns and drives may be seen more clearly in FIG. 2. The lifting floor 2 is situated adjacent the bottom. A spindle nut 26 provided adjacent one of its corners is braced by a lifting spindle 32 the lower end of which is mounted in a spindle bearing 31 on the bottom 13 and the upper end of which is provided with a crank handle 34. Adjacent its lower end the spindle 32 also carries a chain wheel 33 around which an endless drive chain 35 passes. The drive chain 35 is guided in tubes 36 of plastics material and connects the spindle 32 situated in one corner of the swimming pool 1 with the opposing one on the same transverse wall 12. A corresponding pair of spindles 32 is arranged in the neighbouring corners of the opposite transverse walls 12 and connected by a second endless drive chain. At least one of the spindles 32 carries a crank handle at its upper end. Furthermore the two spindles 32 situated in neighbouring corners on a longitudinal wall 11 can also be connected by means of a third endless drive chain thus enabling the height movement of the lifting floor 2 by means of a single crank handle 34. The latter can, of course, be replaced by an electric drive motor.

In FIG. 3 a braced spindle 42 also supported in a spindle bearing 41 on the floor 13 is not connected to the lifting floor 2 but is connected by means of a spindle slide 43, comprising a nut, with an endless load chain 48 arranged close to and parallel to a longitudinal wall 11. The load chain comprises a Gall's chain (plate link chain) whose upper guide wheel 46 is rotatable about an axis 44 supported on column 40 secured to bearing 41, while its lower drive wheel 47 is secured to a shaft 45 which is mounted in bearings 49 and extends from one longitudinal wall 11 to the other one parallel to the transverse wall 12. Turning the spindle 42 by means of a crank handle on its upper end or an electric drive motor allows one end of the lifting floor 2, connected at 25 to chain 48, to be raised independently from the other. The lifting floor can therefore be moved to any desired height and can even be inclined at an angle. This can be important not only for normal bathing but also for cleaning that space of the swimming pool which is underneath the lifting floor 2.

When the lifting floor 2 is built up as a selfsupporting plate it may have apertures 24 which for instance are localized by longitudinal supporting beams 21 and transverse supporting beams which are not shown. Such apertures may be closed by means of covers 27 after the lifting or flapping back of which the space underneath the lifting floor is accessible for visual inspection and for cleaning. Between the supporting beams a filling of synthetic foamed resin or thermally insulating material may be placed. According to their design the covers can also be made of such materials and if necessary may be removable from the apertures between the supporting beams. The seal 28 may comprise a natural or synthetic rubber or an elastomer and may be of open or closed form. Stainless steel, bronze, hard PVC, high molecular weight polyethylene or such like in various combinations may be used as the material for the spindles 32 and 42 and spindle nuts 26 resp. spindle slides 43, whilst the chains 35 and/or 48 may be guided in closed or slotted synthetic tubes of PVC or NEPE.

According to the constructional details and conditions all the drive elements may be housed in housings of suitable materials, in particular plastics for the purpose not only of protection against accidents but also protection against corrosion. For the sake of clarity these housings are not shown in the drawings.

What we claim is:

1. A swimming pool in combination with a lifting floor, comprising:

said swimming pool having integrally joined bottom, longitudinal and transverse walls forming an upwardly opening bathing enclosure, and a generally horizontal rim extending peripherally around the entire upper edges of said longitudinal and transverse walls;

said lifting floor being mounted within said enclosure without permanent attachment to said enclosure, said lifting floor including a self supporting floor generally overlying said bottom wall, a plurality of lifting columns extending through said floor immediately adjacent and generally parallel to said longitudinal and transverse walls, said lifting columns supportingly resting on said bottom wall to extend vertically upward towards said rim, driving means mechanically connected only between each of said lifting columns and that portion of the floor adjacent the corresponding lifting column independently of said longitudinal and transverse walls for selectively changing the elevation of said floor with respect to said bottom wall while supporting the entire weight of said floor on said lifting columns, each of said lifting columns being braced against said floor to prevent said lifting columns from tipping inwardly away from said longitudinal and transverse walls, means only slidably engaging the adjacent portions of said longitudinal and transverse walls without permanent modification of said longitudinal and transverse walls for preventing outward tipping of said floor and columns, and said floor lifting columns and driving means being unconnected with said longitudinal and transverse walls.

2. The swimming pool and lifting floor combination according to claim 1, wheren said floor has a through aperture extending from its topmost surface to its bottommost surface providing a passage for an average adult from above said floor to the space below said floor between said floor and said bottom wall, and a removable cover secured to said floor to completely cover said aperture.

3. The swimming pool and lifting floor combination of claim 2, wherein said driving means includes a helical thread formed on the major portion of the length of said lifting columns, bearings rotatably supporting the lowermost end of said lifting columns on said bottom wall, spindle nuts threadably engaging said thread of said lifting columns, respectively, to move vertically with rotation of said columns, means for rotating said lifting columns, a vertical driving and horizontal bracing connection between said spindle nuts and said floor permitting only rotation of said spindle nuts relative to said floor, a plurality of sprocket means and chain means located entirely beneath said floor drivingly interconnecting at least some of said columns so that rotation of one lifting column will correspondingly and simultaneously rotate another lifting column, a plurality of guide tubes of plastic extending between said lifting columns beneath said floor, and said guide tubes enclosing and guiding said chain means.

4. The swimming pool and lifting floor combination of claim 1, wherein said driving means includes a helical thread formed on the major portion of the length of said lifting columns, bearing rotatably supporting the lowermost end of said lifting columns on said bottom wall, spindle nuts threadably engaging said thread of said lifting columns, respectively, to move vertically with rotation of said columns, means for rotating said lifting columns, a vertical driving and horizontal bracing connection between said spindle nuts and said floor permitting only rotation of said spindle nuts relative to said floor, a plurality of sprocket means and chain means located entirely beneath said floor drivingly interconnecting at least some of said columns so that rotation of one lifting column will correspondingly and simultaneously rotate another lifting column, a plurality of guide tubes of plastic extending between said lifting columns beneath said floor, and said guide tubes enclosing and guiding said chain means.

5. The swimming pool and lifting floor combination of claim 2, wherein at least one of said driving means includes at least one endless chain drivingly secured to the adjacent portion of said floor, a first drive wheel supporting the upper end of said endless chain and being rotatably supported about a horizontal axis on the upper end of the respective one of said lifting columns, and means for driving said chain in an endless path so as to support the adjacent portion of said floor only by said chain and lifting column.

6. The swimming pool and lifting floor of claim 5, wherein the drive means immediately adjacent said one drive means similarly includes a second endless chain drivingly secured to the adjacent portion of said floor, a second drive wheel rotatably supported on the upper end of its lifting column and supporting the upper end of said second endless chain, third and fourth drive wheels respectively for each of said first and second endless chains being rotatably mounted about a horizontal axis parallel to and immediately adjacent said bottom wall, and shaft means beneath said floor drivingly interconnecting said third and fourth drive wheels so that when said means for driving rotates said first endless chain, said fourth drive wheel, third drive wheel and shaft means will correspondingly rotate said second endless chain.

7. The swimming pool and lifting floor of claim 6, wherein said means for rotating includes a threaded spindle extending vertically adjacent said lifting column for rotation about a vertical axis, a spindle slide nut engaging said spindle to be driven vertically with rotation of said spindle, and means drivingly interconnecting said spindle slide nut and said first endless chain.

8. The swimming pool and lifting floor combination of claim 1, wherein at least one of said driving means includes at least one endless chain drivingly secured to the adjacent portion of said floor, a first drive wheel supporting the upper end of said endless chain and being rotatably supported about a horizontal axis on the upper end of the respective one of said lifting columns, and means for driving said chain in an endless path so as to support the adjacent portion of said floor only by said chain and lifting column.

9. The swimming pool and lifting floor combination of claim 8, wherein the drive means immediately adjacent said one drive means similarly includes a second endless chain drivingly secured to the adjacent portion of said floor, a second drive wheel rotatably supported on the upper end of its lifting column and supporting the upper end of said second endless chain, third and fourth drive wheels respectively for each of said first and second endless chains being rotatably mounted about a horizontal axis parallel to and immediately adjacent said bottom wall, and shaft means beneath said floor drivingly interconnecting said third and fourth drive wheels so that when said means for driving rotates said first endless chain, said fourth drive wheel, third drive wheel and shaft means will correspondingly rotate said second endless chain.

10. The swimming pool and lifting floor combination of claim 9, wherein said means for rotating includes a threaded spindle extending vertically adjacent said lifting column for rotation about a vertical axis, a spindle slide nut engaging said spindle to be driven vertically with rotation of said spindle, and means drivingly interconnecting said spindle slide nut and said first endless chain.

11. The swimming pool and lifting floor combination of claim 8, wherein said means for rotating includes a threaded spindle extending vertically adjacent said lifting column for rotation about a vertical axis, a spindle slide nut engaging said spindle to be driven vertically with rotation of said spindle, and means drivingly interconnecting said spindle slide nut and said first endless chain.

* * * * *